US008585441B2

(12) United States Patent
Hsu et al.

(10) Patent No.: US 8,585,441 B2
(45) Date of Patent: Nov. 19, 2013

(54) STRADDLE MOUNTING ELECTRICAL CONNECTOR

(75) Inventors: Chun-Hsiung Hsu, New Taipei (TW); Yue-Ou Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/477,347

(22) Filed: May 22, 2012

(65) Prior Publication Data

US 2012/0302072 A1 Nov. 29, 2012

(30) Foreign Application Priority Data

May 23, 2011 (CN) ..... 2011 1 0133766

(51) Int. Cl.
*H01R 24/00* (2011.01)

(52) U.S. Cl.
USPC ..... 439/637; 439/62; 439/569; 439/79

(58) Field of Classification Search
USPC ..... 439/62, 79, 80, 569, 637
See application file for complete search history.

(56) References Cited

U.S. PATENT DOCUMENTS

| | | | | |
|---|---|---|---|---|
| 5,823,799 | A * | 10/1998 | Tor et al. | 439/79 |
| 5,897,386 | A * | 4/1999 | Baxter et al. | 439/79 |
| 6,341,988 | B1 * | 1/2002 | Zhu et al. | 439/630 |
| 8,075,343 | B2 | 12/2011 | Fu | |
| 8,277,232 | B2 * | 10/2012 | Herring et al. | 439/79 |
| 2011/0151701 | A1 * | 6/2011 | Ngo | 439/327 |
| 2012/0302072 | A1 * | 11/2012 | Hsu et al. | 439/61 |

* cited by examiner

*Primary Examiner* — James Harvey
(74) *Attorney, Agent, or Firm* — Ming Chieh Chang; Wei Te Chung

(57) ABSTRACT

An electrical connector adapted to be straddle mounted to a PCB and a method for mounting such an electrical connector. The electrical connector includes a housing defining a datum to abut the bottom side of the PCB and an upper row of contacts fastened in the housing. Each upper contact has a flexible mounting portion extending from the housing to abut the top side of the PCB. The mounting portions of the top contacts and the datum of the housing is adapted to clip the PCB thereby positioning the electrical connector related to the PCB.

15 Claims, 5 Drawing Sheets

STRADDLE MOUNTING ELECTRICAL CONNECTOR

BACKGROUND OF THE INVENTION

1. Field of the Invention

The present invention relates to a connector to be straddle mounted to a PCB, and particularly to a straddle mounting connector with structures for positioning the connector and the PCB.

2. Description of Related Art

U.S. Pat. No. 8,075,343, issued to Fu et al. on Dec. 13, 2011, discloses a straddle mounting connector adapted to be mounted to a front edge of a printed circuit board (PCB). The contacts of the connector are mated with the PCB. The electrical connections between the contacts and the PCB may not be so stable as the electrical connection if the contacts were soldered with the PCB. Even if solder connections were applied between the contacts and the PCB, since the position of the connector relative to the PCB is not well controlled, the connector might be offset from desired position, making it difficult to solder and further affecting the stablility of the connection therebetween.

Therefore, there is a need for a connector which could be stably straddle mounted cross a tongue edge of a PCB.

SUMMARY OF THE INVENTION

The present invention provides an electrical connector adapted to be straddle mounted cross a horizontal printed circuit board (PCB) having a bottom side and a top side opposite to the bottom side. The electrical connector comprises a housing defining a datum to abut the bottom side of the PCB, and an upper row of contacts fastened in the housing, each upper contact having a flexible mounting portion extending from the housing along the top side of the PCB. The mounting portions of the top contacts and the datum of the housing clip the PCB.

The present invention also provides a method for straddle mounting an electrical connector to a PCB, comprising:

(1) forming a housing having a horizontal datum facing upwardly;

(2) forwardly inserting a row of upper contacts into the housing to form the electrical connector, each of the upper contacts having a mounting portion lined in an upper row, a receiving space formed between the datum of the housing and the mounting portions of the upper contacts;

(3) providing a PCB having a front edge with a top side and an opposite bottom side;

(4) backwards putting the connector across the front edge of the PCB with the mounting portions of the upper contacts and the datum of the housing clipping the PCB; and (5) soldering the mounting portion of the upper contacts and the PCB.

Other objects, advantages and novel features of the invention will become more apparent from the following detailed description of a preferred embodiment when taken in conjunction with the accompanying drawings.

DETAILED DESCRIPTION OF THE INVENTION

Figure 1:
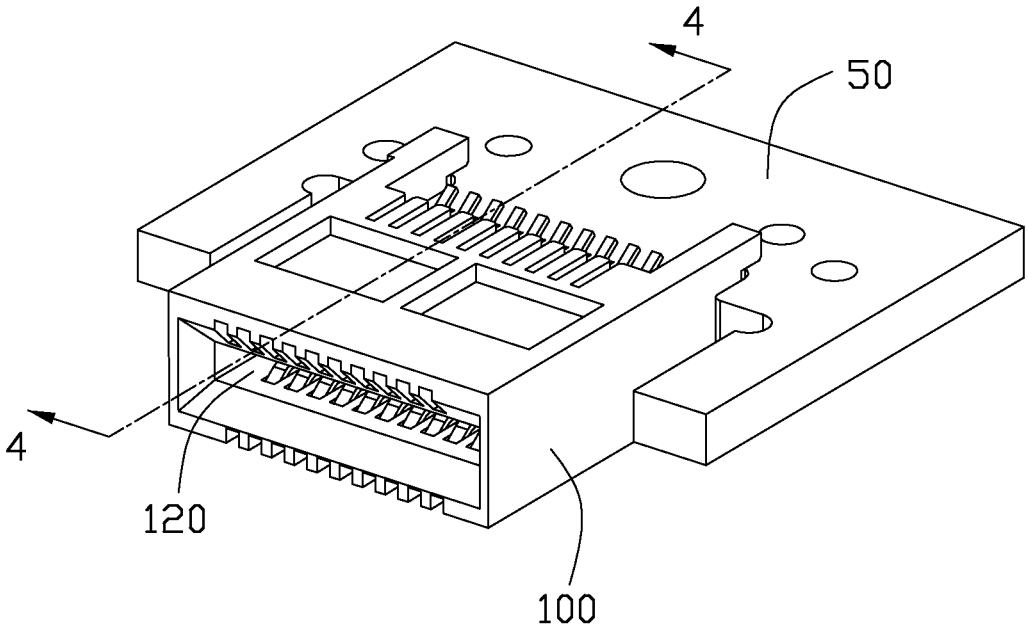
FIG. 1 is a perspective view of a straddle mounting connector mounted across a front edge of a PCB according to an embodiment of present invention.

Reference will now be made to the drawing figures to describe the present invention in detail.

Figure 2:
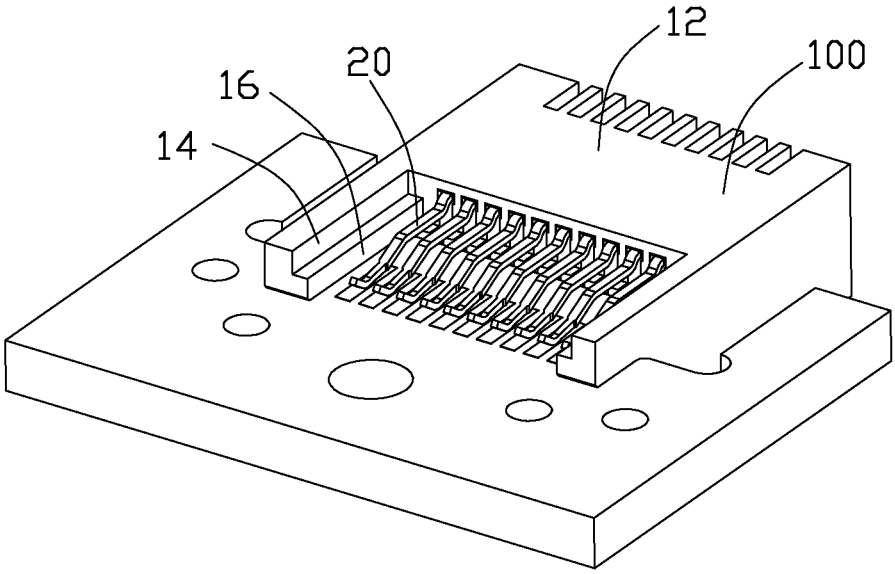
FIG. 2 is another perspective view of the straddle mounting connector and the PCB shown in FIG. 1.
Figure 3:
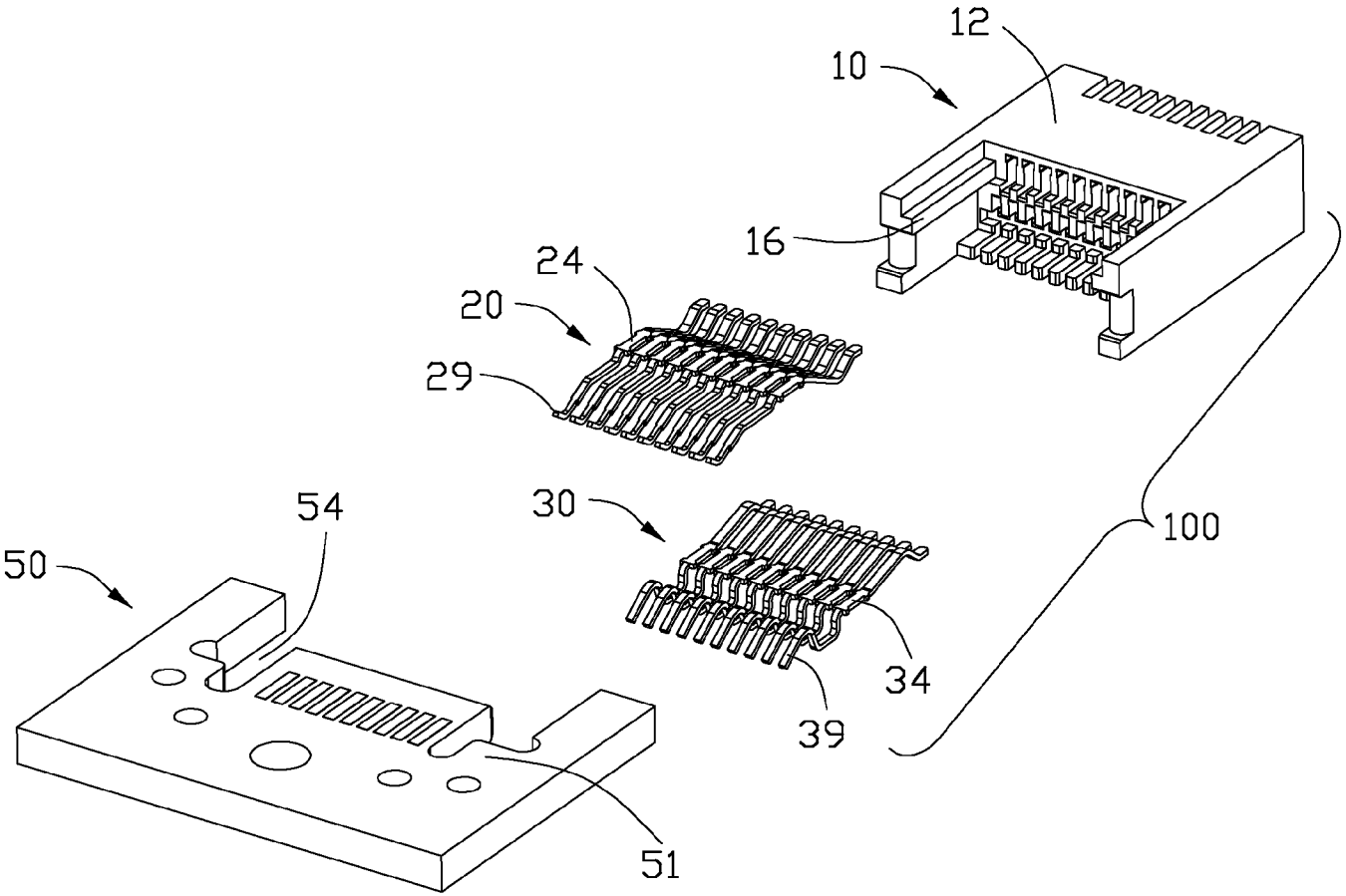
FIG. 3 is an exploded view of a bottom connector of the straddle mounting connector and the PCB shown in FIG. 1.

Referring to FIGS. 1-3, an SFP connector 100 adapted to be straddle mounted to a horizontal printed circuit board 50 (PCB) is shown. The electrical connector 100 includes a housing 12 defining a datum, an upper row of contacts 30 and a lower row of contacts 20 fastened in the housing 12. The PCB 50 has a front tongue board edge having a bottom side 51 and a top side 53 opposite to the bottom side 51.

Figure 4:
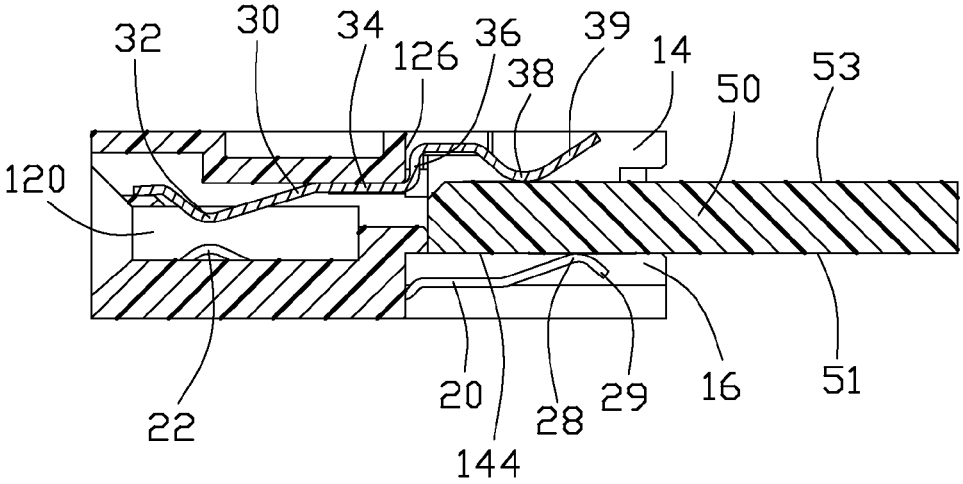
FIG. 4 is a cross-section of the straddle mounting connector and the PCB shown in FIG. 1, taken along a line IV-IV.

Referring to FIG. 4, the electrical connector 100 is best shown straddling across the tongue board edge of the PCB 50. Each upper contact 30 has a flexible mounting portion 38 extending backwardly from the housing 12 and flexibly abutting the top side 53 of the PCB 50. The datum of the housing 12 abuts the bottom side 51 of the PCB 50 and thus the tongue edge of the PCB 50 is clipped by the mounting portions 38 of the top contacts 30 and the datum of the housing 12. Each of the upper contacts 30 further comprises a fastening portion 34 fixed by the housing 12 and a vertical portion 36 bent upwardly from a rear end of the fastening portion 34. The mounting portion 38 rearwards extends from an upper end of the vertical portion 36. Each of mounting portions 38 of the upper contacts 30 has a guiding portion 39, so that the connector 100 could be easily put across the front tongue edge of the PCB 50. The vertical portions 36 provide a stop against a rear face 126 of the housing 12 when the upper contacts 30 are inserted into the housing 12 and a protect in case that the mounting portion 38 were over deformed when the electrical connector 100 is put across the front tongue edge of the PCB 50.

Each of the lower contacts 20 also has a mounting portion 28 adapted to be mounted on the bottom side 51 of the PCB 50. The mounting portions 28 of the lower contacts 20 just slightly touch the bottom side 51 of the PCB 50 and not provide any force to position the electrical connector 100 with the PCB 50. Each of mounting portions 28 of the lower contacts 20 has a guiding portion 29, so that the connector 100 could be easily put across the front tongue edge of the PCB 50. The guiding portion 39 of each upper contact 30 extends a length greater than the length of the guiding portion 29 of each lower contact 20, which results that the mounting portion 38 of each upper contact 30 could make a greater deformation to abut against the front tongue edge of the PCB 50, so that the connector 100 could slide along the datum when the connector 100 is put across the front tongue edge of the PCB 50.

Referring to FIGS. 3 and 4, the housing 12 defines a front slot 120 for receiving a mating card edge having conductive pads (not shown). Each of the lower contacts 20 has a contacting portion 22 disposed at a bottom side of the front slot 120. Each of the upper contacts 30 having a contacting portion 32 disposed at a top side of the front slot 120. When the mating card edge is inserted into the front slot 120, the contacting portion 32, 22 of the upper contacts 30 and the lower contacts 20 contact with the conductive pads and make electrical connections there between.

Figure 5:
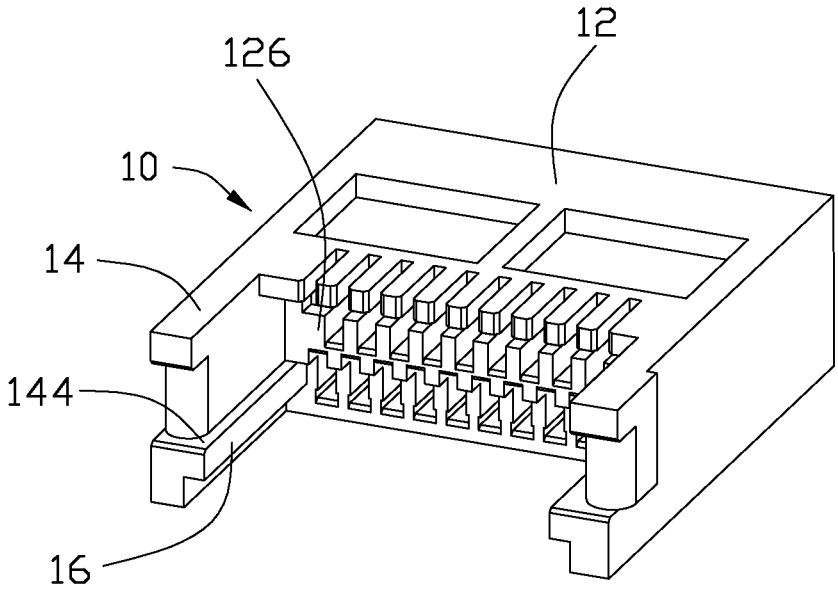
FIG. 5 is a perspective view of a housing of the straddle mounting connector.

Referring to FIGS. 4 and 5, the housing 12 forms a pair of guiding posts 14 beside longitudinal opposite ends of the housing 12. The pair of guiding posts 14 extend backwards and each forms an inner rib 16 having a top step face 144 to define the datum. The step face 144 extends backwardly beyond the mounting portion 38 of the upper contacts 30 and provide a stable position for the electrical connector 100. When the electrical connector 100 is backwardly mounted across the PCB 50, the guide posts 14 slide into a pair of guide slots 54 defined by the PCB 50, thereby limits the position in a longitudinal direction along the front edge of the PCB.

A method for straddle mounting an electrical connector 100 to a PCB 50, including the following steps:

(1) forming a housing 12 having a horizontal datum 144 facing upwardly;

(2) forwardly inserting a row of upper contacts 30 and a row of lower contacts 20 into the housing 12 to form the electrical connector 100, each of the upper contacts 30 having a mounting portion 38 lined in an upper row, each of the lower contacts 20 having a mounting portion 28 lined in a lower row, a receiving space formed between the datum of the housing 12 and the mounting portions 38 of the upper contacts 30;

(3) providing a PCB 50 having a front edge with a top side 53 and an opposite bottom side 51;

(4) backwardly clipping the connector 100 across the front edge of the PCB 50 by the mounting portions 38 of the upper contacts 30 and the datum of the housing 12; and (5) soldering the mounting portion 38 of the upper contacts 30 and the PCB 50.

(6) soldering the mounting portions 28 of the lower contacts 20 and the PCB 50 after the step (5).

It should be noticed that the mounting portions 38 should be soldered before the mounting portions 28 are soldered, or otherwise, the connector could be not positioned in the right position (tilted related to the PCB 50).

The disclosure is illustrative only, changes may be made in detail, especially in matter of shape, size, and arrangement of parts within the principles of the invention.

What is claimed is:

1. An electrical connector adapted to be straddle mounted to a horizontal printed circuit board (PCB) having a bottom side and a top side opposite to the bottom side, comprising: a housing defining a datum to abut the bottom side of the PCB that is horizontally aligned with a lower contacting portion 22 (see FIG. 4); and an upper row of contacts fastened in the housing, each upper contact having a flexible mounting portion rearwardly extending from the housing to abut the top side of the PCB, wherein the mounting portions of the top contacts and the datum of the housing are adapted to clip the PCB.

2. An electrical connector as claimed in claim 1, further comprising a lower row of contacts, each lower contact having a mounting portion adapted to be mounted on the bottom side of the PCB.

3. An electrical connector as claimed in claim 2, wherein the housing defines a front slot for receiving a mating card edge, each of the lower contacts having the lower contacting portion disposed at a bottom side of the front slot and each of the upper contacts having a contacting portion disposed at a top side of the front slot.

4. An electrical connector as claimed in claim 2, wherein the housing forms a pair of guiding posts beside longitudinal opposite ends, the guiding posts extending rearwards and being adapted to mate into a pair of guide slots defined by the PCB.

5. An electrical connector as claimed in claim 4, wherein each of the guiding posts defines a step face to form the datum of the housing.

6. An electrical connector as claimed in claim 5, wherein the step face extends backwardly beyond the mounting portion of the upper contact.

7. An electrical connector as claimed in claim 3, wherein each of the upper contacts comprises a fastening portion fixed by the housing and a vertical portion bent upwardly from the fastening portion, the mounting portion extending rearwards from the vertical portion.

8. An electrical connector as claimed in claim 7, wherein each of the lower contacts comprises a fastening portion fixed by the housing, the contacting portion extending forwardly and upwardly slantwise from the fastening portion, the mounting portion extending rearwards and upwardly from the fastening portion.

9. An electrical connector as claimed in claim 8, wherein each mounting portion of the upper contacts and the lower contacts has a guiding portion extending rearwards, the guiding portion of each upper contact extending a length greater than the length of the guiding portion of each lower contact.

10. An electrical connector as claimed in claim 7, wherein the vertical portion serves as a stop during inserting the upper contacts into the housing.

11. An electrical connector as claimed in claim 2, wherein the mounting portions of the upper contacts and the lower contacts are soldered to the PCB.

12. A method for straddle mounting an electrical connector to a PCB, comprising: (1) forming a housing having an upper inner rib having a top step face that defines a horizontal datum facing upwardly; (2) forwardly inserting a row of upper contacts into the housing to form the electrical connector, each of the upper contacts having a mounting portion lined in an upper row, a receiving space formed between the datum of the housing and the mounting portions of the upper contacts; (3) providing a PCB having a front edge with a top side and an opposite bottom side; (4) backwardly clipping the connector across the front edge of the PCB by the mounting portions of the upper contacts and the datum of the housing; and (5) soldering the mounting portions of the upper contacts and the PCB.

13. A method for straddle mounting an electrical connector to a PCB as claimed in claim 12, further comprising a step of inserting a row of lower contacts into the housing, the lower contacts having mounting portions lined in a lower row in such condition that a receiving space is formed between the upper row of mounting portions of the upper contacts and the lower row of mounting portions of the lower contacts to receive the front edge of the PCB.

14. A method for straddle mounting an electrical connector to a PCB as claimed in claim 13, further comprising a step (6) of soldering the mounting portions of the lower contacts and the PCB, the step (6) being performed after the step (5).

15. An electrical connector adapted to be straddle mounted to a horizontal printed circuit board (PCB) having a bottom side and a top side opposite to the bottom side, comprising:

a housing defining a datum to abut the bottom side of the PCB;

an upper row of contacts fastened in the housing, each upper contact having a flexible mounting portion rearwardly extending from the housing to abut the top side of the PCB, the mounting portions of the top contacts and the datum of the housing are adapted to clip the PCB;

a lower row of contacts, each lower contact having a mounting portion adapted to be mounted on the bottom side of the PCB;

the housing defines a front slot for receiving a mating card edge, each of the lower contacts having a contacting portion disposed at a bottom side of the front slot and each of the upper contacts having a contacting portion disposed at a top side of the front slot; and each of the upper contacts comprises a fastening portion fixed by the housing and a vertical portion bent upwardly from the fastening portion, the mounting portion extending rearwards from the vertical portion.

* * * * *